US005673487A

United States Patent [19]

Malagnoux

[11] Patent Number: 5,673,487

[45] Date of Patent: Oct. 7, 1997

[54] CUTTING PLIERS FOR PLASTIC MATERIAL SECTIONS, RUBBER-LIKE JOINTS AND SIMILAR

[75] Inventor: Roger Malagnoux, Domont, France

[73] Assignee: Estbablissements Pierre Grehal et Compagnie S.A., Val d'Oise, France

[21] Appl. No.: 446,035

[22] Filed: May 19, 1995

[30] Foreign Application Priority Data

Aug. 23, 1994 [FR] France ..... 94 10213

[51] Int. Cl.[6] ..... B26B 17/00

[52] U.S. Cl. ..... 30/179; 30/289; 30/339; 30/351

[58] Field of Search ..... 30/179, 233, 289, 30/293, 333, 337, 339, 351

[56] References Cited

U.S. PATENT DOCUMENTS

| | | | |
|---|---|---|---|
| 799,617 | 9/1905 | Steffa | 30/233 |
| 841,729 | 1/1907 | Smith | 30/333 |
| 1,527,220 | 2/1925 | Pyle | 30/289 |
| 1,558,711 | 10/1925 | Nittinger | 30/333 |
| 1,570,599 | 1/1926 | Goff | 30/333 |
| 1,719,217 | 7/1929 | Freiss | 30/333 |
| 1,796,847 | 3/1931 | LeClerc | 30/333 |
| 1,908,851 | 5/1933 | LaFever et al. | 30/333 |
| 2,530,216 | 11/1950 | Appel | 30/333 |
| 2,582,736 | 1/1952 | Altieri . | |
| 3,431,645 | 3/1969 | Powell | 30/293 |
| 3,448,519 | 6/1969 | Tobias | 30/293 |
| 3,457,643 | 7/1969 | Hill | 30/293 |
| 4,106,195 | 8/1978 | Berg | 30/233 |
| 4,272,888 | 6/1981 | Hartmeister | 30/233 |
| 4,369,682 | 1/1983 | Bunnell | 83/112 |

FOREIGN PATENT DOCUMENTS

| | | | |
|---|---|---|---|
| 474915 | 1/1905 | France . | |
| 656162 | 6/1920 | France . | |
| 656943 | 7/1928 | France . | |
| 2425771 | 5/1974 | Germany . | |
| 348227 | 5/1925 | United Kingdom | 30/179 |

*Primary Examiner*—Kenneth E. Peterson
*Assistant Examiner*—Sean A. Pryor
*Attorney, Agent, or Firm*—Paul & Paul

[57] ABSTRACT

Cutting pliers for plastic material sections, rubber-like joints and similar, including two levers (6, 7) articulated to each other on an axis (8) and kept spread apart by a spring (9), characterized in that one of the levers (6) supports an anvil (11) while the other lever (7) is provided with a blade-carrier (16) on which a blade is fixed in a removable manner.

1 Claim, 3 Drawing Sheets

CUTTING PLIERS FOR PLASTIC MATERIAL SECTIONS, RUBBER-LIKE JOINTS AND SIMILAR

FIELD OF THE INVENTION

The present invention relates to new cutting pliers which are particularly usable for cutting plastic material sections used in the building industry, as well as rubber-like joints and similar.

BACKGROUND AND OBJECT OF THE INVENTION

In many cases, it is necessary to be able to cut plastic material sections in a very accurate and neat manner. It is the case of hollow sections which are used with tiles for covering the edge of the end rows of wall tiles. It is also the case of sealing joints for openings, windows, doors, mutilayer glazings, etc.

The sections or joints have to present straight cuts as well as mitred cuts, possibly according to several angles, in order to be assembled end to end on the site of utilization as such and in a manner that said sections seem to ensure a perfect continuity.

The invention solves the problem.

SUMMARY OF THE INVENTION

According to the invention, the pliers for cutting plastic material sections including two levers articulated to each other on an axis and kept spread apart by a spring are characterized in that one of the levers supports an anvil while the other lever is provided with a blade-carrier on which a blade is fixed in a removable manner.

Various other features of the invention will become more apparent from the following detailed description.

BRIEF DESCRIPTION OF THE DRAWINGS

An embodiment of the object of the invention is shown by way of a non limiting example in the accompanying drawing.

DETAILED DESCRIPTION OF A PREFERRED EMBODIMENT

Figure 1:
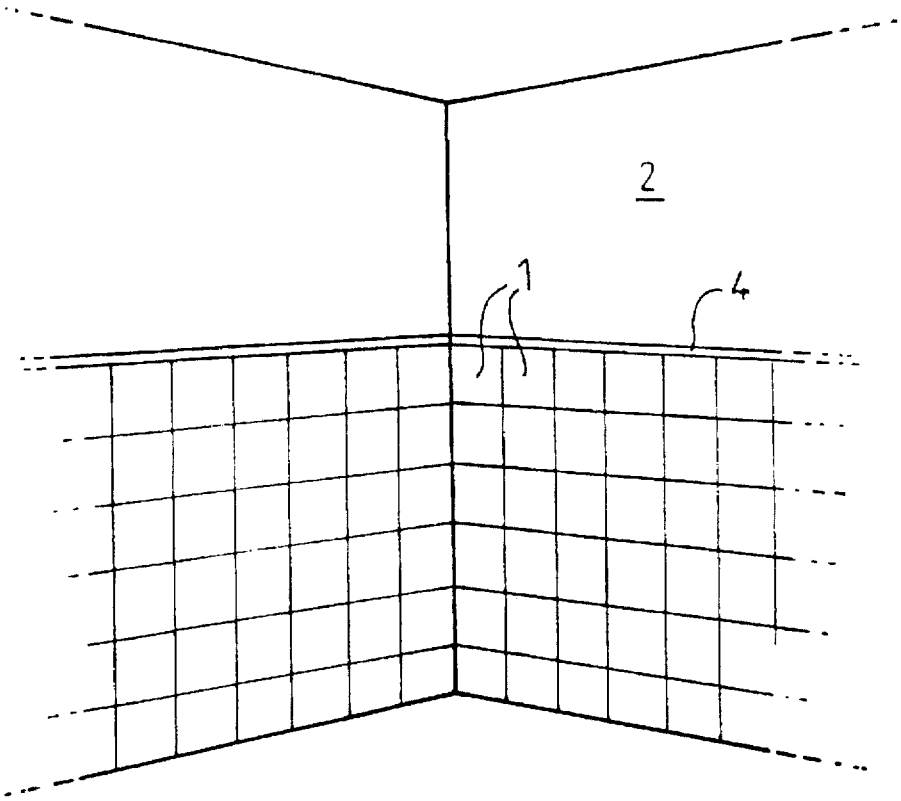
FIG. 1 is a partial perspective view of a room with tiled walls.
Figure 2:
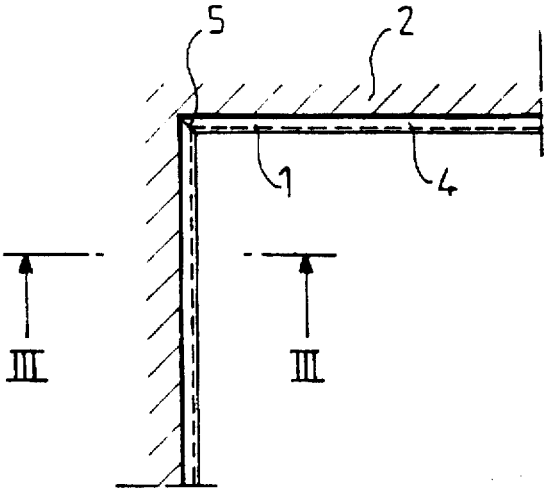
FIG. 2 is a top view corresponding substantially to FIG. 1.
Figure 3:
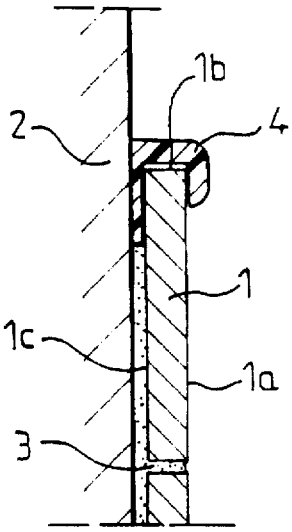
FIG. 3 is a sectionnal view at a larger scale along line III—III of FIG. 2.

FIGS. 1 to 3 show a wall tiling made of tiles 1 fixed to the wall 2 by an appropriate glue. Tiles 1, well visible in FIG. 1, can be made of various materials, for example in glazed baked clay and it appears in this case, with reference to FIG. 3, that face 1*a* is conveniently treated while the side edges 1*b* receive only a small quantity of glaze, which makes them more or less porous. The same applies to the rear face 1*c* which, most often, is left in the raw state.

The partial glazing of the tiles hereabove described is in a sense a savings, and it allows on the other hand a better grip of the glue 3 on the side edges and the rear face and therefore a better hold of the tiles on the walls 2.

In the foregoing, the word glaze is used to mean all the covering materials, that is generally speaking the enamels. In order to take in account the foregoing and ensure a good finish of the wall tiling when this tiling does not cover the wall up to the ceiling, it is usual to cover the last row of tiles with a section 4 which, most often, is an extruded thermoplastic section with a colour substantially the same as that of the tiles.

Considering FIGS. 1 and 2, one should observe that in most cases the tiling has to be placed on walls forming between themselves an angle which is most often 90°.

The section 4 has to be cut in a very accurate manner at its end, also at the junction portion 5 which requires a cut at 45° of the two section lengths which have to be brought together in order to ensure the continuity of the covering of the last row of tiles.

Figure 4:
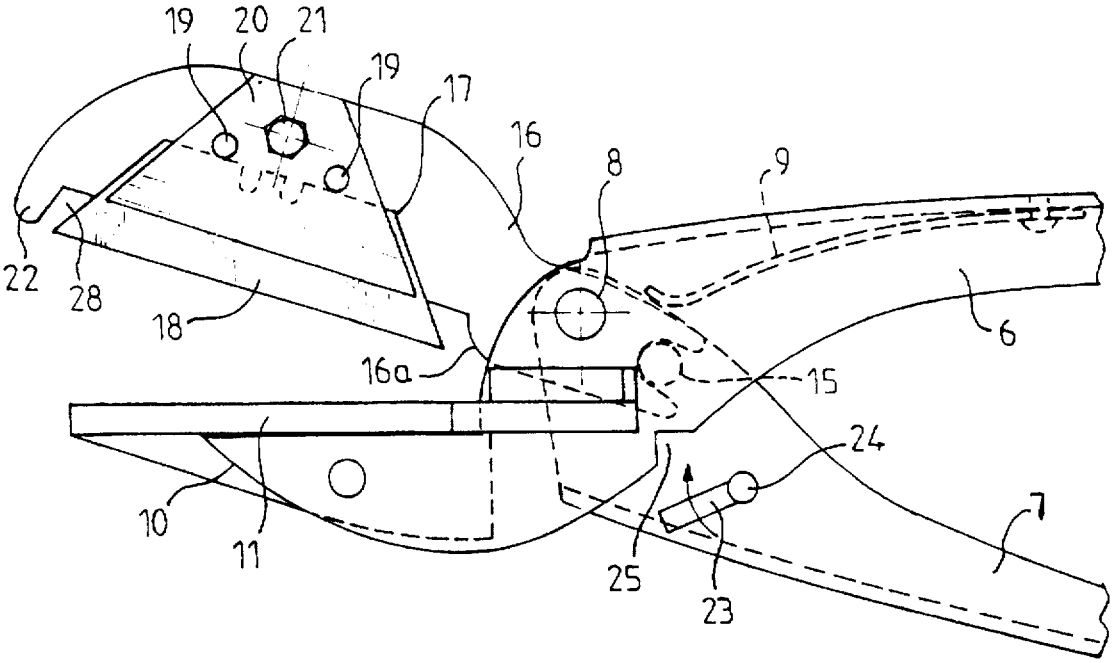
FIG. 4 is a partial elevation view of the anterior working portion of the pliers.
Figure 5:
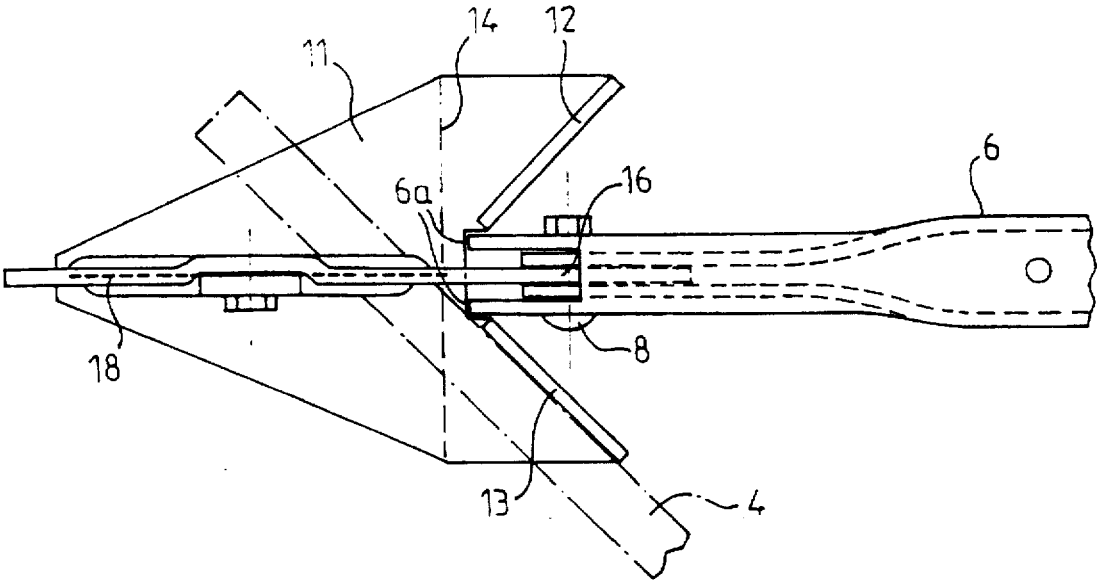
FIG. 5 is a top plan view corresponding to FIG. 4.

FIGS. 4 and 5 show pliers according to the invention which allow making straight cuts as well as angle cuts of various plastic sections, notably extruded thermoplastic sections, in order particularly to use the sections cut in the manner described hereabove.

The pliers shown include two levers 6, 7 made of metallic sections folded longitudinally substantially in the shape of a U. These sections, one of which, section 7, being narrower than the other, section 6, are engaged into one another and articulated on an axis 8.

A leaf spring 9 or similar is mounted in one of the levers, the one designated at 6 in the drawing, in order to come to bear on the other lever, and therefore tend to spread apart these two levers.

Lever 6 which ends into two branches 10, of which only one is apparent, forms a support at its end for an anvil 11 which is preferably made of a synthetic material, for example polyurethane or an elastomer.

Anvil 11 is formed with a plane top, bordered in its rear portion by two standing-up edges 12, 13 extending at a right angle one with respect to the other.

Figure 6:
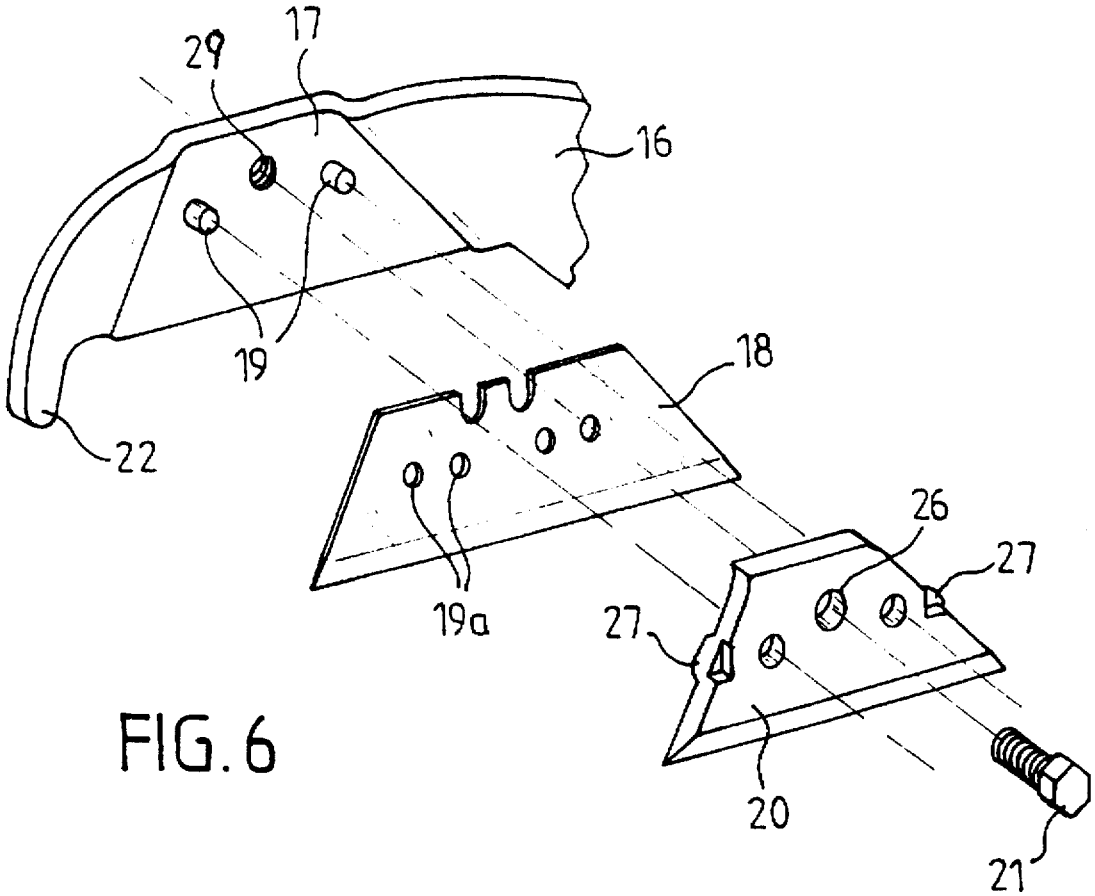
FIG. 6 is an exploded perspective view showing a detailed view of the blade assembly.
Figure 7:
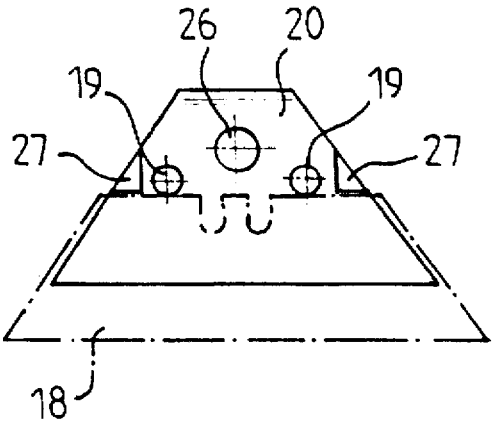
FIG. 7 is an elevation view showing the cooperation between the various parts shown in FIG. 6.

It is also advantageous that the end of lever 6 forms an abutment, as shown at 6*a*, corresponding to a line 14, for example a groove provided in the sole of anvil 11, for forming a mark of reference. The lever 7 supports, via an axis 8 and an abutment 15, a blade-carrier 16 having a housing 17 formed by a recessed portion well visible in FIG. 6 for a blade 18 centred against studs 19. Blade 18 is preferably of a trapezium shape and of a type which is currently in the trade for serving as a blade for cutting devices called cutters. To this effect, blade 18 has in its upper edge notches and two sets of holes 19*a* for its adaptation to several devices.

The blade 18 is held on the blade-carrier 16 by a counter-plate 20 and a clamping bolt 21 extending through the counter-plate via a hole 26 and screwed in an inner thread 27 or similar of the blade-carrier 16. Studs 19 ensure also the centering of the counter-plate by bearing on the top of the blade.

Bolt 21 can be of any type, for example with ears, so that it can be handled without any tool, or it can be of the hexagonal head type, as shown, or of another type.

In order to prevent any rotary motion of blade 18 with respect to the blade-carrier 16, the counter-plate 20 is formed laterally with protrusions 27 protruding rearwardly and forming abutments applying against the ends of the upper edge of blade 18. In this way, blade 18 cannot pivot in any circumstances even when subjected to irregular efforts, for example when cutting a part with one of its side edges.

Blade 18, placed in the housing of blade-carrier 16, is, with the exception of its cutting edge, covered by counter-plate 20, thereby ensuring its protection and that of the user. On the other hand and as shown particularly in FIG. 4, the blade-carrier 16 is formed in its anterior portion with a beak 22 extending beyond the forward point of the cutting edge of blade 18. Thus, none of the ends of blade 18 is easily accessible since the end opposite to that protected by beak 22 is protected by the rear portion 16*a* of blade-carrier 16, as is well shown in FIG. 4.

Moreover, beak 22 defines with blade 18 a disengagement notch 28 which is sufficiently wide for a part cut by the front end of the cutting edge of the blade not to be marked by the blade-carrier.

When one wishes to cut a section, this section is placed on anvil 11, for example as shown for section 4 in FIG. 5, meaning that it is applied against one of the standing-up edges of the anvil, in that case edge 13.

By bringing together levers 6, 7 pressed by hand, blade 18 severs the section along an angle of 45°.

In order to make a right angle joint, the section is then positioned against the standing-up edge 12 and the same operation if repeated.

When a straight cut has to be made, the section is placed so as to follow outline 14 while bearing on the abutment 6*a*. The severing is done in the same manner as described in the foregoing.

Generally speaking, it is the cutting edge of blade 18 which is nearer to abutment 16*a* which is worn most rapidly.

The mounting hereabove described of blade 18 on blade-carrier 16 allows turning over blade 18 so that both ends are successively usable. This is done by simply loosening bolt 21 and lifting counter-plate 20.

The change of blade 18 by a new blade is done in the same manner and without any difficulty.

The pliers described hereabove can be provided with various types of latches to maintain it in the closed position so as to protect the blade and avoid any accident. For example, the latch can be made as shown in FIG. 4 and include a finger 23 pivoting about an axis 24 so as to be engaged inside a notch 25 of lever 6 when blade 18 is brought against anvil 11.

The invention is not limited to the embodiment shown and described in detail and various modifications can be carried out without departing from its scope.

What I claimed is:

1. A cutting pliers device for cutting plastic material sections, rubber joints, comprising a first and a second lever articulated to each other on an axis, and biased apart by a spring, said first lever supporting an anvil, and said second lever being provided with a blade carrier on which a straight edge blade is fixed in a removable manner, wherein the blade is held by centering studs and a counter-plate rigidly attached to the blade carrier with a removable nut, said counter-plate being formed with protrusions to prevent pivoting motion of the blade with respect to the blade carrier, wherein said anvil comprises two edges that stand at right angles to a base of the anvil for alignment of a workpiece in two different angled positions, wherein the blade carrier has a protective beak disposed adjacent said blade, said beak, at all times, extending beyond said blade forming a protected disengagement groove, wherein the blade is disposed in a recessed area of the blade carrier, wherein the anvil is made of a synthetic material, wherein the blade carrier has a housing formed by a recessed portion for containing the blade, such that said blade can be flipped to an opposite side to improve blade wear.

* * * * *